United States Patent [19]

Truskolaski et al.

[11] 4,329,382

[45] May 11, 1982

[54] SELF-LOCKING RIBBON ASSEMBLIES

[75] Inventors: Bernard S. Truskolaski, Lake Elmo; Daniel P. Pohl, Grant Township, Washington County, both of Minn.

[73] Assignee: Minnesota Mining and Manufacturing Company, St. Paul, Minn.

[21] Appl. No.: 204,884

[22] Filed: Nov. 7, 1980

[51] Int. Cl.[3] ..... D04D 7/10

[52] U.S. Cl. ..... 428/4; 428/101; 428/195

[58] Field of Search ..... 428/4, 5, 101, 195; 2/244; 112/410, 411

[56] References Cited

U.S. PATENT DOCUMENTS 3,632,464 1/1972 Grikis ..... 428/4

3,637,455 1/1972 Pearson et al. ..... 428/4

*Primary Examiner*—Henry F. Epstein

*Attorney, Agent, or Firm*—Cruzan Alexander; Donald M. Sell; William L. Huebsch

[57] ABSTRACT

A ribbon assembly including face-to-face bow ribbons attached together at spaced locations around a pull member attached to their ends that can be pulled to gather the bow ribbons into a bow. Upon such pulling an end portion of the assembly is pulled between the attachment locations to hold the bow ribbons together in the shape of a bow.

8 Claims, 11 Drawing Figures

SELF-LOCKING RIBBON ASSEMBLIES

TECHNICAL FIELD

The present invention relates to ribbon assemblies which may be changed from a flat condition for convenient storage and shipment into a bow for use on an article such as a package by moving portions of the ribbon assembly relative to each other.

BACKGROUND ART

Such a ribbon assembly is described in U.S. Pat. No. 3,637,455. That ribbon assembly includes a pair of face-to-face ribbons having first aligned ends attached together and which are also attached together at spaced locations along their opposite edges; and a pull member or string attached to the first ends of the ribbons and extending between the ribbons. A user holds the ribbons along their edges adjacent the attachment locations most distant from their attached ends and pulls the pull member, whereupon the attachment locations along their edges move together along the pull member, causing portions of the ribbons between the attachment locations and between the attachment locations and the attached ends to billow out and form a bow. It is then necessary to hold the attached locations of the ribbons adjacent each other as by tying the pull member around an object positioned at the base of the bow; or by applying a decorative, bendable thin metal clip around the center of the bow whereupon the pull member can be torn away, and the bow can be attached to a package as by adhesive or tape. If it is desired to use the bow in combination with a second ribbon around an object such as a package, that second ribbon must first be attached around the package and the bow can then be attached to its surface.

DISCLOSURE OF INVENTION

The present invention provides a ribbon assembly which may be changed from a flat condition into a bow, which assembly is self-locking to retain the shape of the bow after it is formed without tying a pull member in the assembly to an object or the application of holding clips, and which, in some embodiments includes a second pair of ribbons that can be applied around an article such as a package to which the bow is applied to hold the bow in place.

The ribbon assembly according to the present invention comprises a first pair of elongate bow ribbons having specially shaped end portions attached together and to an end of a pull member adjacent their terminal ends. The bow ribbons are wider than and disposed on opposite sides of the pull member, and have edge portions extending past the adjacent edges of the pull member which are attached together at spaced locations. The attachment locations include a first set of opposite attachment locations adjacent and spaced a predetermined short distance from the attached first ends of the bow ribbons, and a second set of opposite attachment locations adjacent the ends of the bow ribbons opposite their attached first ends. When a user holds the bow ribbons adjacent the second set of attachment locations and pulls the pull member to move the attached first ends of the bow ribbons toward the second set of attachment locations, the attachment locations will gather adjacent each other while the portions of the bow ribbons between the attachment locations and between the attachment locations and the attached first ends will billow outwardly to form a bow, and the end portions of the bow ribbons will be pulled to a position with an edge surface of those end portions engaging the first set of attachment locations and a part of the end portions extending through the first set of attachment locations toward the second set of attachment locations. Self-locking means are provided on the ribbon assembly for then holding the second set of attachment locations and any attachment locations between the first and second sets of attachment locations at a predetermined distance from the first set of attachment locations to maintain the shape of the bow; which means, in one embodiment, may be a disproportionately thick portion of the ribbon assembly, which thick portion forms around the attachments between the end portions of the bow ribbons and the pull member and is pulled via the pull member between the second set of attachment locations as the bow is formed, and then, because of its thickness, restricts movement of the end portions of the ribbons back between the second set of attachment locations; and in another embodiment, in which the pull member is a second pair of tie ribbons in face-to-face relationship, comprises projections on each of the tie ribbons adjacent and projecting toward their first ends, which projections either interlock with the bow ribbons or with each other after the projections are pulled to the side of the second set of attachment locations opposite the first set of attachment locations.

BRIEF DESCRIPTION OF THE DRAWING

The present invention will be further described with reference to the accompanying drawing wherein like numerals refer to like parts in the several views, and wherein.

DESCRIPTION OF THE PREFERRED EMBODIMENTS

Figure 1:
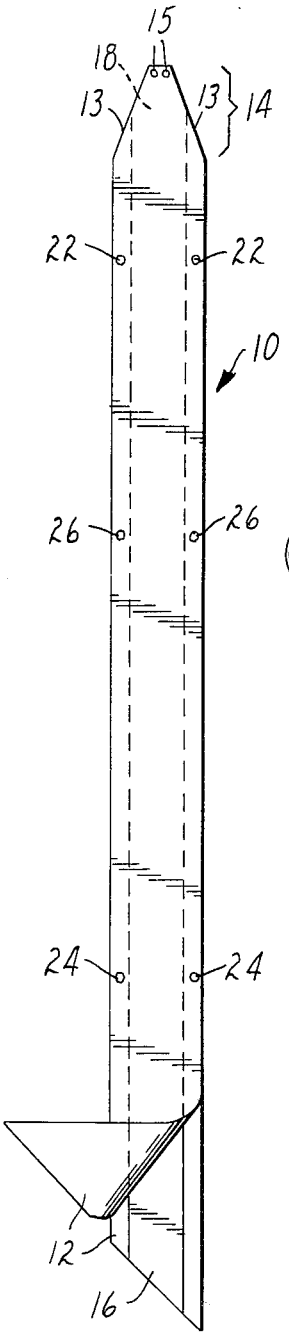
FIG. 1 is a front plan view of a first embodiment of a ribbon assembly according to the present invention.

Referring now to FIGS. 1 through 6 there is shown a first embodiment of a ribbon assembly according to the present invention generally designated by the reference numeral 10.

As is best seen in FIG. 1, the ribbon assembly 10 comprises a first pair of opposed elongate bow ribbons 12 having tapered first end portions 14 with converging edge surfaces 13, which tapered end portions 14 are aligned and attached together (as by heat fusion or sonic welding) at locations 15 adjacent their ends; and a pull member in the form of a second pair of face-to-face elongate tie ribbons 16 also having tapered first end portions 18 aligned with and attached to the tapered end portions 14 of the bow ribbons 12 at the locations 15. The bow ribbons 12 are wider than the tie ribbons 16 and are disposed in opposed relationship face-to-face on opposite sides of the tie ribbons 16. The bow ribbons 12 have edge portions extending past the adjacent edges of the tie ribbons 16 on both sides, which edge portions are fastened together (as by heat fusion or sonic welding) at spaced attachment locations including at a first set of transversely opposite attachment locations 22 adjacent and spaced a predetermined short distance from the tapered end portions 14 of the bow ribbons 12, at a second set of transversely opposite attachment locations 24 adjacent the ends of the bow ribbons 12 opposite their tapered end portions 14, and at a third set of opposite attachment locations 26 spaced between the first and second sets of attachment locations 22 and 24 more closely to the first set 22 than to the second set 24.

Figure 2:
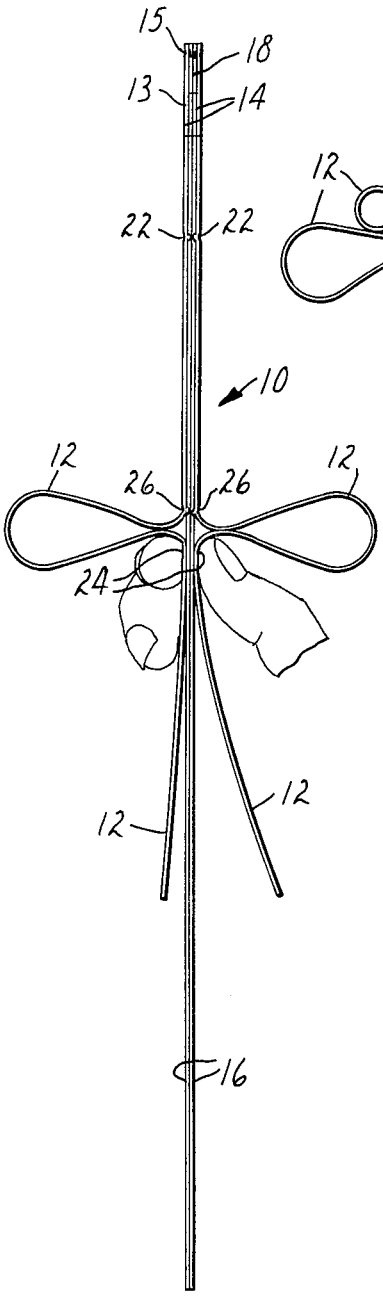
FIG. 2 is a side view of the ribbon assembly of FIG. 1 being formed into a bow by a user.
Figure 3:
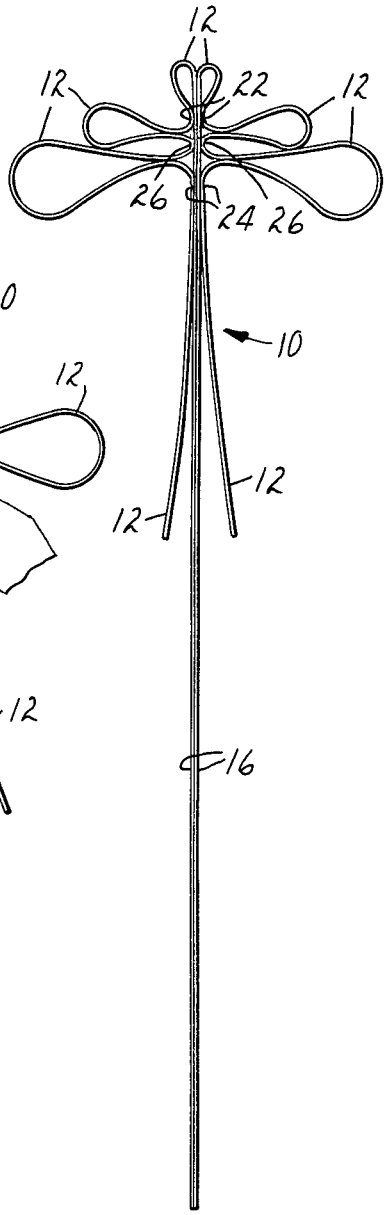
FIG. 3 is a side view of the ribbon assembly of FIG. 1 after it has been formed into a bow.
Figure 6:
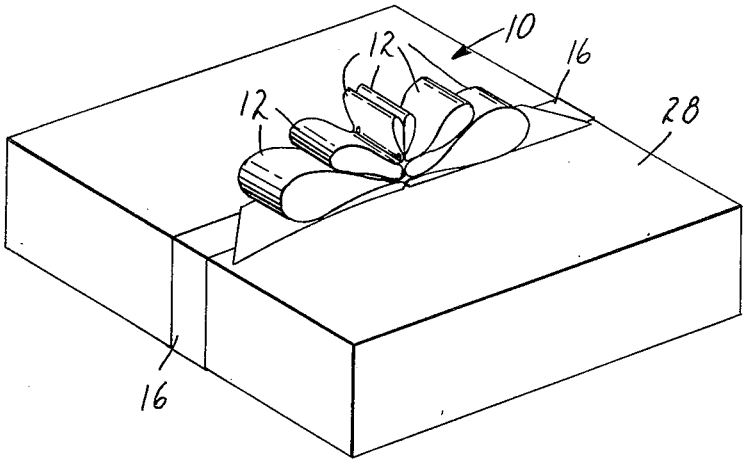
FIG. 6 is a perspective view of the bow of FIG. 3 shown attached to a package.
Figure 4:
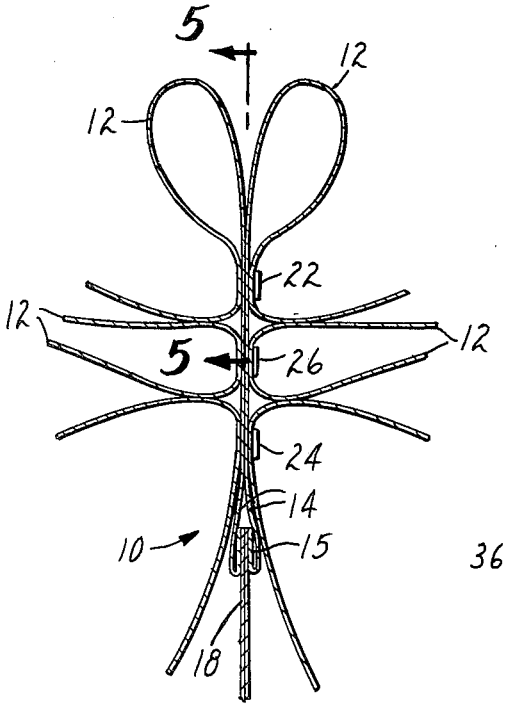
FIG. 4 is an enlarged fragmentary view of the bow shown in FIG. 3.
Figure 5:
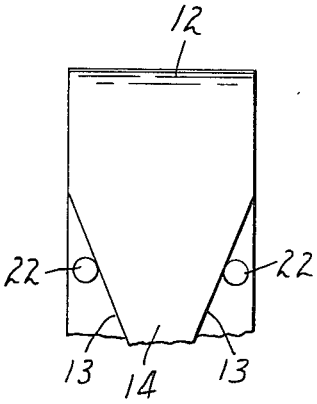
FIG. 5 is a fragmentary sectional view taken approximately along line 5—5 of FIG. 4.

As illustrated in FIG. 2, when the bow ribbons 12 are held adjacent the second set of attachment locations 24 and the tie ribbons 16 are pulled to move the tapered end portions 14 and 18 of the bow and tie ribbons 12 and 16 toward and through the sets of opposed attachment locations 22, 24 and 26, the attachment locations 22, 24 and 26 along the edge portions of the bow ribbons 12 will gather adjacent each other, the portions of the bow ribbons 12 between the attachment locations 22, 24, and 26 and between the first attachment location 22 and the tapered end portions 14 of the first pair of ribbons 12 will billow outwardly to form a bow (FIGS. 2, 3, and 4) and, as is best seen in FIGS. 4 and 5, the tapered end portions 14 of the bow ribbons 12 will move to a position with the edge surfaces 13 along their widest portions abutting the first set of attachment locations 22, and the more narrow parts of the tapered end portions 14 extending through the first, third, and second sets of attachment locations 22, 26, and 24 so that the attachment locations 15 between the tapered end portions 14 and 18 of the bow and tie ribbons 12 and 16 are on the side of the second set of attachment locations 24 opposite the first set of attachment locations 22. Such movement will cause the tapered end portions 14 of the bow ribbons 12 to fold back over the attachment locations 15 between the tapered end portions 14 and 18 (FIG. 4) to form a disproportionately thick portion of the bow assembly 10 around the attachment locations 15, which thick portion will not easily move back between the second set of attachment locations 24. The parts of the tapered end portions 14 of the bow ribbons 12 between the thick portion of the ribbon assembly 10 around the attachment locations 15 and the edge surfaces 13 engaged with the first attachment locations 22 (FIG. 5) will hold the attachment locations 22, 24, and 26 closely adjacent each other to retain the shape of the bow. Thus the thickened portion of the ribbon assembly 10 formed around the attachment locations 15 as the bow is formed provides self-locking means adapted to be pulled to a position on the side of the second set of attachment locations 24 opposite the first set of attachment locations 22 upon formation of the bow, which self-locking means will resist movement back through the second set of attachment locations 24 to hold the attachment locations 22, 24, 26 adjacent each other and retain the shape of the bow.

As illustrated, the tie ribbons 16 have a combined length adapted to extend around an article such as a package 28 (FIG. 6) to which the bow is to be attached. Alternatively, however, the pull member or second pair of ribbons 16 could be adapted to be torn away after the bow is formed as by perforating them adjacent the attachment location 15 on their first end portions 18, or as illustrated in FIG. 7 could be replaced by a single more narrow pull member 33 adapted to be torn from a ribbon assembly 32.

Figure 7:
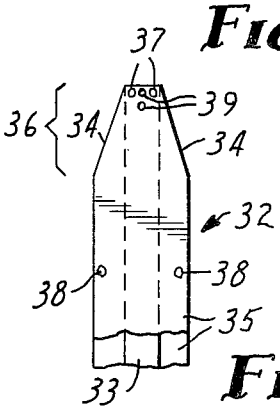
FIG. 7 is a fragmentary front plan view of a second embodiment of a ribbon assembly according to the present invention.
Figure 8:
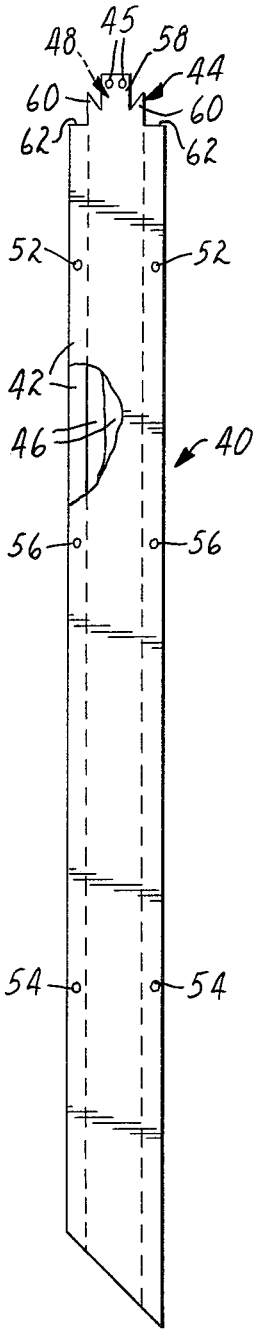
FIG. 8 is a front plan view of a third embodiment of a ribbon assembly according to the present invention.
Figure 9:
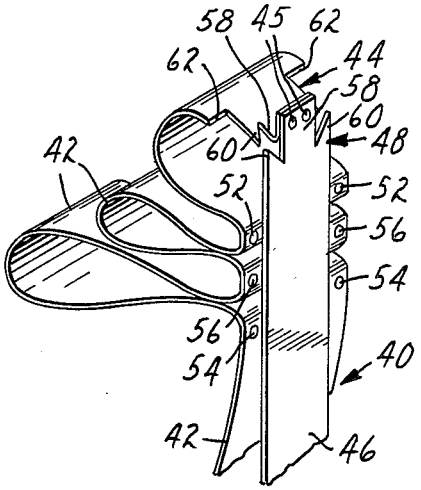
FIGS. 9 and 10 are fragmentary perspective views of half of the ribbon assembly of FIG. 8 being formed into a bow.
Figure 10:
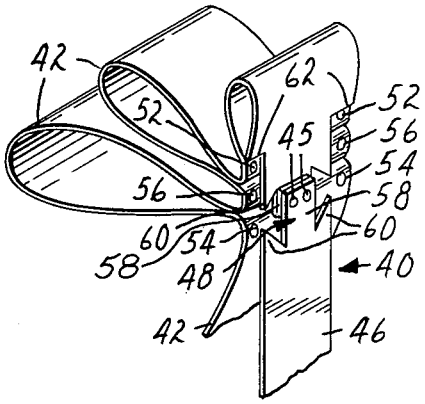
Figure 11:
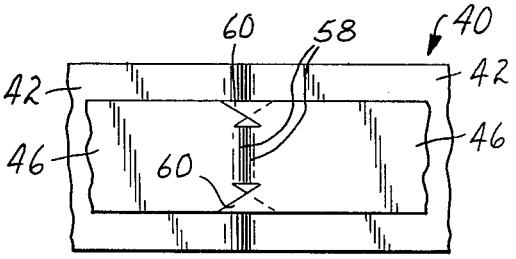
FIG. 11 is a fragmentary bottom view of portions of the bow of FIG. 10 showing the engagement of locking projections thereof.

As is seen in FIG. 7, the ribbon assembly 32 comprises a pair of opposed elongate bow ribbons 35 having tapered end portions 36 with converging edge surfaces 34, which tapered end portions 36 are aligned and attached together at locations 37 adjacent their ends; and the single pull member or ribbon 33 attached between the tapered end portions 36 of the bow ribbons 35 at the locations 37. The bow ribbons 35 are much wider than the pull member 33, are disposed in opposed relationship face-to-face on opposite sides thereof, and have edge portions extending past the adjacent edges of the pull member 33 on both sides, which edge portions are fastened together at spaced attachment locations including at a first set of transversely opposite attachment locations 38 adjacent and spaced a predetermined short distance from the tapered end portions 36 of the bow ribbons 35, at a second set of transversely opposite attachment locations adjacent the ends of the bow ribbons 35 opposite their tapered end portions 36, and a third set of opposite attachment locations spaced between the first and second sets of attachment locations. The second and third sets of attachment locations are not shown but could be in the same positions relative to the first set of attachment locations 38 as the second and third sets of attachment locations 24 and 26 are with respect to the first set of attachment locations 22 in the ribbon assembly 10.

The ribbon assembly 32 is formed into a bow (not shown) in essentially the same manner as the ribbon assembly 10 whereupon the tapered end portions 36 of the bow ribbons 35 have moved to a position with their edge surfaces 34 along their widest portions abutting the first set of attachment locations 38, and the more narrow parts of the tapered end portions 36 extending through the first, third, and second sets of attachment locations so that the attachment locations 37 between the tapered end portions 36 of the bow ribbons 35 and the pull member 33 are on the side of the second set of attachment locations opposite the first set of attachment locations 38. Such movement will have caused the tapered end portions 36 of the bow ribbons 35 to fold back over the attachment locations 37 between the tapered end portions 36 and the pull member 33 to form a disproportionately thick portion of the ribbon assembly 32 around the attachment locations 37, which thick portion will not easily move back between the second set of attachment locations. Thus, the parts of the tapered end portions 36 of the bow ribbons 35 between the thick portion of the ribbon assembly 32 around the attachment locations 37 and the edge surfaces 34 engaged with the first attachment locations 38 will hold the attachment locations closely adjacent each other to retain the shape of the bow. Also, such folding back of the bow ribbons 35 over the attachment locations 37 causes certain of longitudinally spaced openings 39 through the tapered end portions 36 and pull member 33

(one of which openings 39 is aligned between the attachment locations 37 between the end portions 36 and the pull member 33) to move into alignment with each other so that a wire can be inserted through the four openings 39 in the end portions 36 and the opening 39 adjacent the end of the pull member 33 (which are aligned) and the wire can then be used to fasten the bow to an object. The pull member 33 can be torn away whereupon it will either tear adjacent one of the openings 39 through it, and/or pull free at the attachment locations 37.

Referring now to FIGS. 8 through 11 there is shown a second embodiment of a ribbon assembly according to the present invention generally designated by the reference numeral 40.

The ribbon assembly 40 comprises a first pair of opposed elongate bow ribbons 42 having first specially shaped end portions 44 aligned and attached together at locations 45 adjacent their ends, and a pull member in the form of a second pair of face-to-face elongate tie ribbons 46 also having first specially shaped end portions 48 aligned with and attached to the first end portions 44 of the bow ribbons 42 at the locations 45. The bow ribbons 42 are wider than the tie ribbons 46 and are disposed in opposed relationship face-to-face on opposite sides of the tie ribbons 46. The bow ribbons 42 have edge portions extending past the adjacent edges of the tie ribbons 46 on both sides, which edge portions are fastened together at spaced attachment locations including at a first set of transversely opposite attachment locations 52 adjacent and spaced a predetermined short distance from the first end portions 44 of the bow ribbons 42, at a second set of transversely opposite attachment locations 54 adjacent the ends of the bow ribbons 42 opposite their first end portions 48, and at a third set of opposite attachment locations 56 spaced between the first and second sets of attachment locations 52 and 54 more closely to the first set 52 than to the second set 54.

The specially shaped end portions 44 and 48 on the bow and tie ribbons 42 and 46 (the functions of which will later be explained) each include a narrow longitudinally projecting central part 58 at the distal end of which are the attachment locations 45 between the bow and tie ribbons 42 and 46; and generally right triangular parts or projections 60 flanking the central part 58 and having pointed ends spaced from the central part 58 and projecting longitudinally away from the main portions of the ribbons 42 and 46. Also, the bow ribbons 42 have end surfaces 62 extending transversely of the bow ribbons 42 from the bases of the projections 60 to the longitudinal edges of the bow ribbons 42.

When the bow ribbons 42 are held adjacent the second set of attachment locations 54 and the tie ribbons 46 are pulled to move the first end portions 44 and 48 of the bow and tie ribbons 42 and 46 toward and through the first set of opposed attachment locations 52, the attachment locations 52, 54 and 56 along the edge portions of the bow ribbons 42 will gather adjacent each other (FIG. 9); the portions of the first pair of ribbons 42 between the attachment locations 52, 54 and 56 and between the first attachment locations 52 and the end portions 44 of the bow ribbons 42 will billow outwardly to form a bow (FIGS. 9 and 10); the narrow central parts 58 of the bow ribbons 42 will fold back over their points of attachment 45 to the narrow central parts 58 of the tie ribbons 46 so that the central parts 58 on the ribbons 42 and 46 extend away from each other (FIG. 10); the transverse end surfaces 62 on the bow ribbons 42 will be pulled into engagement with and be stopped by the first set of attachment locations 52 (FIG. 10); and the narrow oppositely extending central parts 58 of the bow and tie ribbons 42 and 46 will be pulled through the sets of attachment locations 52, 56, and 54 so that the projections 60 on the tie ribbons 46 are on the side of the second set of attachment locations 54 opposite the first set of attachment locations 52. In this position, the projections 60 on the tie ribbons 46 will either engage the bow ribbons 42 adjacent the second set of attachment locations 54, or will engage and interlock with each other when the tie ribbons 46 are positioned to extend in opposite directions from the second set of attachment locations 54 (FIG. 11) to restrict movement of the projections 60 on the tie ribbons 46 back between the second set of attachment locations 54. The oppositely extending narrow central parts 58 of the bow and tie ribbons 42 and 46 extending between the transverse end surfaces 62 of the first pair of ribbons 42 engaged with the first set of attachment locations 52 and the projections 60 engaged with the bow ribbons 42 or each other at the side of the second set of attachment locations 54 opposite the first set 52 hold the attachment locations 52, 54 and 56 closely adjacent each other to retain the shape of the bow. Thus the projections 60 on the second pair of ribbons 46 provide self-locking means adapted to be pulled to a position on the side of the second set of attachment locations 54 opposite the first set of attachment locations 52 upon formation of the bow, which self-locking means will resist movement back through the second set of attachment locations 52 to hold the attachment locations 52, 54, 56 adjacent each other and retain the shape of the bow. The projections 60 on the first pair of ribbons 42 serve no purpose, but are formed by a die that cuts the projections 60 on the second pair of ribbons 46 after the ribbons 42 and 46 are attached together.

As illustrated, the tie ribbons 46, like the tie ribbons 16 of the ribbon assembly 10, have a combined length adapted to extend around an article such as a package to which the bow is to be attached.

Suitable materials for the ribbons in any of the ribbon assemblies 10, 32 or 40 may include, but are not limited to, embossed polypropylene, foamed oriented extruded polyethylene, or acetate or rayon which may be woven, spun bonded or nonwoven and formed in layers of different materials or structures. Suitable ribbons having such or similar structures are sold under the trademarks "Lacelon," "Decorette," "Sasheen" or "Sasheen 1000," and are available from Minnesota Mining and Manufacturing Company of St. Paul, Minn.

The present invention has now been described with reference to three embodiments thereof, and it will be apparent to those skilled in the art that many changes could be made in the structure of the bow assemblies without departing from the spirit of the present invention. For example, the portions of the ribbons pulled between and engaged adjacent the second attachment locations to hold the attachment locations adjacent each other after the bow is formed to retain the shape of the bow could have outer edges adapted to engage the second set of attachment locations or could have a combination of thickness and width to provide that effect. Thus, the structure of the ribbon assembly as claimed should not be limited to the structures illustrated, but only by the structures described by the claims and their equivalents.

We claim:

1. A ribbon assembly adapted to be formed into a bow, said ribbon assembly comprising:

a pull member of a first width and having a first end;

a pair of elongate bow ribbons having first ends generally aligned with the first end of said pull member, being attached to said pull member at a location adjacent said first ends, having a width wider than said first width, being disposed on opposite sides of said pull member with edge portions of said bow ribbons extending past the adjacent edges of said pull member on both sides, being attached together at spaced attachment locations along said edge portions including a first set of opposite attachment locations spaced a predetermined distance from said first ends and a second set of generally opposite attachment locations adjacent the ends of said bow ribbons opposite said first ends, and having end portions adjacent said first ends which end portions have edge surfaces with portions spaced at a distance corresponding to the spacing between said first set of attachment locations and parts projecting beyond said edge surface portions of a width adapted to move between said attachment locations so that when said bow ribbons are held adjacent said second set of attachment locations and said pull member is pulled to move said first ends toward and through said first set of attachment locations, said attachment locations will gather adjacent each other, portions of said bow ribbons between said attachment locations and between said attachment locations and said end portions will billow outwardly to form a bow, said edge surface portions on the end portions of said bow ribbons will engage and be stopped by said first set of attachment locations, and said parts of said end portions will pass and extend between said first attachment locations; and self-locking means adapted to be pulled to a position on the side of said second set of attachment locations opposite said first set of attachment locations upon formation of said bow, which self-locking means will resist movement back through said second set of attachment locations to hold said attachment locations adjacent each other and retain the shape of said bow.

2. A ribbon assembly according to claim 1 wherein said parts of said end portions have lengths adapted to extend between said second attachment locations upon formation of said bow to position said first ends at the side of said second attachment locations opposite said first attachment locations, and said self-locking means comprises a thickened portion of said ribbon assembly around said first ends that restricts movement of said first ends back through said second set of attachment locations.

3. A ribbon assembly according to claim 2 having longitudinally spaced openings through said end portions and pull member adjacent said first end, the openings in said end portions being adapted to move into alignment and to be aligned with the opening in said pull member adjacent said first end upon formation of said bow to provide a through opening adapted to receive a wire for fastening the bow to an object.

4. A ribbon assembly according to claim 2 or 3 wherein said pull member is adapted to be torn away upon formation of said bow.

5. A ribbon assembly according to claim 2 including a second pair of face-to-face tie ribbons providing said pull member, said tie ribbons having a combined length adapted upon formation of said bow to attach the bow to an object.

6. A ribbon assembly according to claim 1 including a second pair of face-to-face tie ribbons providing said pull member.

7. A ribbon assembly according to claim 6 wherein said pair of tie ribbons each have generally triangular projections adjacent and projecting toward said first ends, said projections being spaced from said first ends to be pulled to the side of said second pair of attachment locations opposite said first pair of attachment locations upon formation of said bow to provide said self-locking means.

8. A ribbon assembly according to claim 7 wherein said tie ribbons have a combined length adapted upon formation of said bow to attach the bow to an object, and the projections on one tie ribbon are adapted to engage the projections on the other tie ribbon upon positioning the tie ribbons to extend in generally opposite directions from said second set of attachment locations.

* * * * *